US007111478B2

(12) United States Patent
Fukui et al.

(10) Patent No.: US 7,111,478 B2
(45) Date of Patent: Sep. 26, 2006

(54) DRUM WASHING MACHINE

(75) Inventors: Takashi Fukui, Moriguchi (JP); Kunioki Honda, Moriguchi (JP); Harumi Takeuchi, Moriguchi (JP); Yorihisa Funada, Moriguchi (JP); Minoru Yoshida, Moriguchi (JP); Hiroyuki Hoshino, Moriguchi (JP); Yuji Ozeki, Moriguchi (JP)

(73) Assignee: Sanyo Electric Co., Ltd., Osaka (JP)

( * ) Notice: Subject to any disclaimer, the term of this patent is extended or adjusted under 35 U.S.C. 154(b) by 256 days.

(21) Appl. No.: 10/375,069

(22) Filed: Feb. 28, 2003

(65) Prior Publication Data

US 2003/0172688 A1 Sep. 18, 2003

(30) Foreign Application Priority Data

Mar. 6, 2002 (JP) ..... 2002-059787

(51) Int. Cl.
*D06F 33/00* (2006.01)
*D06F 37/00* (2006.01)

(52) U.S. Cl. ..... 68/12.24; 68/12.26; 68/24; 68/140

(58) Field of Classification Search ..... 68/12.26, 68/24, 140, 144, 146, 12.24
See application file for complete search history.

(56) References Cited

U.S. PATENT DOCUMENTS 4,499,847 A * 2/1985 Dunaitschik ..... 118/19
4,696,377 A * 9/1987 Richardson et al. ..... 188/170
5,267,456 A * 12/1993 Nukaga et al. ..... 68/12.24
5,437,168 A 8/1995 Mason et al.
5,438,766 A * 8/1995 Nakamura ..... 34/602
6,539,753 B1 * 4/2003 Ito et al. ..... 68/3 R
2003/0061841 A1 * 4/2003 Nakamura et al. ..... 68/12.26
2003/0089138 A1 * 5/2003 Kawamura et al. ..... 68/17 R

FOREIGN PATENT DOCUMENTS

CN A-1128310 8/1996
CN A-1293277 5/2001
DE 4132863 A1 * 4/1993
DE 10154208 A1 * 6/2002
EP 347393 A2 * 12/1989
JP A-63-311991 12/1988
JP A-9-122374 5/1997
JP 11318052 A * 11/1999

* cited by examiner

*Primary Examiner*—Michael Barr
*Assistant Examiner*—Sarah E. Husband
(74) *Attorney, Agent, or Firm*—Oliff & Berridge, PLC.

(57) ABSTRACT

An engaging groove part 25 is provided at the outer circumferential edge of a rotor 20*b* of an outer-rotor type motor directly connected to the main shaft 14 of a drum 13, and on the other hand, a drum locking device 21 is provided directly below the shaft. The drum locking device 21 is constructed so that a lock pin moves up and down in response to rotation of a torque motor, and when the lock pin advances and fits into the groove of the engaging groove pan 25, the position of the drum 13 is fixed. Thereby, the stopping position of the drum can be fixed with a simple construction.

2 Claims, 11 Drawing Sheets

Fig. 7A RELEASED
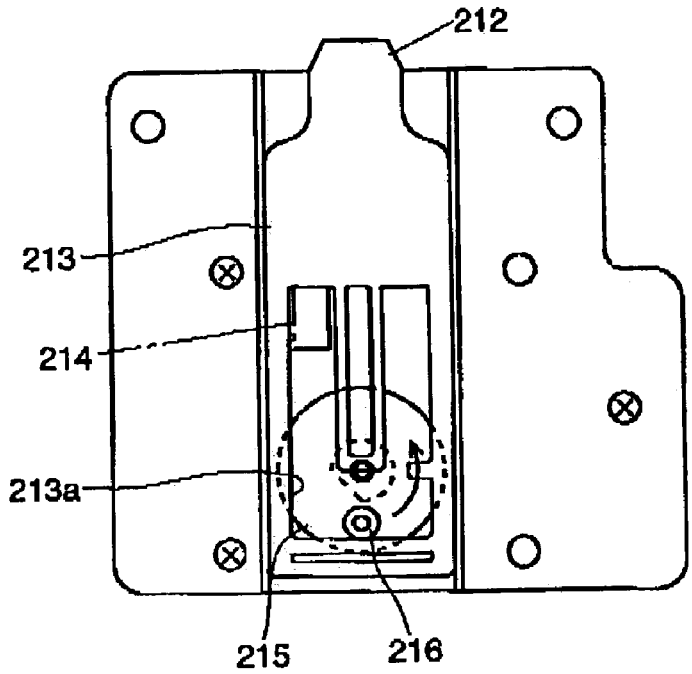
Fig. 7B LOCKED
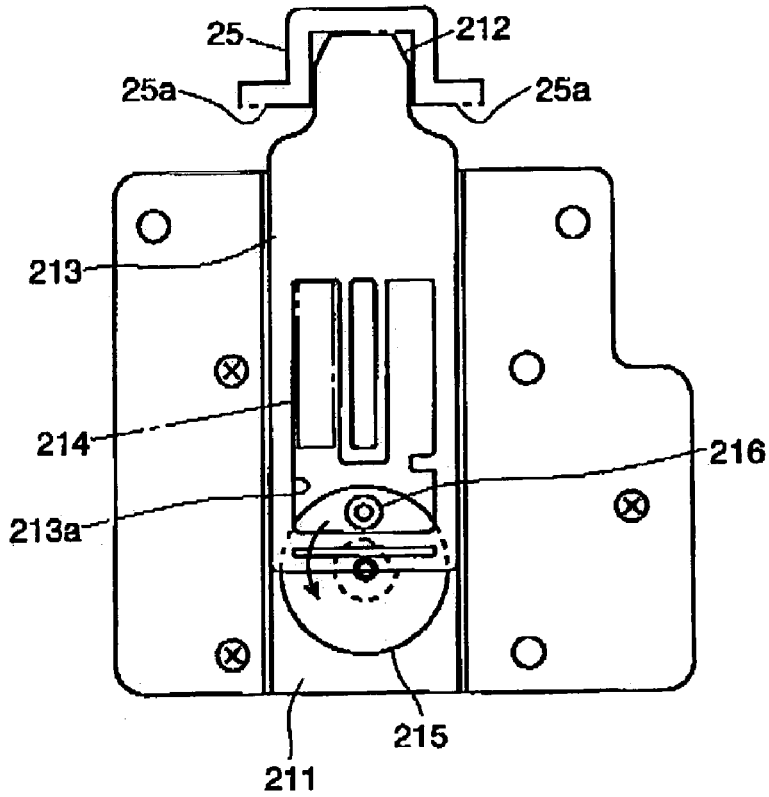

DRUM WASHING MACHINE

The present invention relates to a drum washing machine having a drum which rotates around a horizontal shaft or on an inclined shaft. Generally, a drum washing machine means a drum washer-dryer which performs washing through drying sequentially, however, a drum washing machine mentioned herein may not perform drying.

BACKGROUND OF THE INVENTION

A drum washing machine is constructed so that a cylindrical basket-shaped drum is disposed inside an outer tub in a manner enabling it to rotate about a horizontal shaft or an inclined shaft, and laundry is accommodated in the drum and rotated in the outer tub storing water to tumble-wash the laundry. In such a general drum washing machine, a door for loading laundry is provided in a side-opening manner on the front face of a substantially rectangular outer casing, and when the door is opened, a laundry-loading opening provided at one end face of the drum is exposed through an opening provided in the outer tub.

One of the great complaints of typical consumers regarding such a drum washing machine is the difficulty in loading and taking out laundry. Namely, in the drum washing machine constructed as mentioned above, the laundry-loading opening is set at a low position, and the difficulty in loading laundry cannot be completely eliminated even by placing the washing machine on an exclusive placing base. In order to meet such a complaint, a drum washing machine in which a drum has a laundry-loading opening provided slightly diagonally upward has been conventionally commercially available. Furthermore, it has been attempted to make the laundry-loading opening as large as possible. However, for a consumer who has become used to the usability of a whirling washing machine, it cannot be necessarily said that the usability of the drum washing machine is satisfactory.

A possible method to improve such poor usability in the drum washing machine is to provide the laundry-loading opening at the top of the outer casing instead of the front face as in the case of the conventional general whirling washing machine. In a case where the laundry-loading opening is provided at the top of the outer casing, since it is required that an outer tub opening and a drum opening are provided at positions aligned with the loading opening, the openings are provided at the circumferential surfaces instead of the end faces of the outer tub and drum. However, although the position of the outer tab is fixed, the drum is rotatable in the outer tub, so that it is necessary that the drum stops at a rotational position at which the opening made in the drum is completely aligned with the opening made in the outer tub. Therefore, a mechanism which can securely and quickly fix the rotational position of the drum when the drum stops ("drum stopping position") with a simple construction is demanded.

SUMMARY OF THE INVENTION

The present invention has been made in order to solve the abovementioned problem, and a main object thereof is to provide a drum washing machine which can fix the drum stopping position so that the drum opening position and the outer tub opening position are aligned with each other with a simple structure. Another object of the invention is to provide a highly reliable drum washing machine which prevents the parts including the drum from being damaged or broken when the drum stopping position is fixed. Still another object of the invention is to provide a drum washing machine which can securely or quickly fix the drum stopping position According to a first aspect of the invention to achieve the abovementioned objects, a drum washing machine in which a drum whose circumferential surface is substantially cylindrical is provided inside an outer tub provided inside an outer casing so as to be rotatable around a horizontal shaft or an inclined shaft comprises, for fixing the rotational position of the drum at a predetermined stopping position, a) first engager including a torque motor and an actuator which moves between two positions in response to rotation of the torque motor, and b) second engager provided on the drum or on a member which rotates integrally with the drum, and positioned so as to engage with a part of the actuator when the actuator is at a first position and to release the engagement when the actuator is at a second position.

In the drum washing machine according to the first aspect of the invention, for example, when a cover member for opening and closing a laundry-loading opening formed in the outer casing is opened or when an outer tub door for opening and closing an outer tub opening formed at the circumferential surface of the outer tub is opened, it is required that the drum is stopped at a position at which the laundry-loading opening, the outer tub opening, and a drum opening formed in the drum correspond to each other. Since a torque motor for driving the actuator is used so as to perform such a stopping operation, it is prevented that loud noise is generated as in the case of a solenoid, and a high degree of silence can be maintained. Furthermore, even when the engagement with the second engager is not proper and the actuator stays in a condition where its movement is obstructed between the first position and the second position, an abnormally large current or a back electromotive force are prevented from flowing and being generated, and therefore, such obstruction hardly results in breakage, and high reliability can be maintained.

According to a second aspect of the invention to achieve the abovementioned objects, a drum washing machine in which a drum whose circumferential surface is cylindrical is provided inside an outer tub provided in an outer casing so as to be rotatable around a horizontal shaft or an inclined shaft, comprises a) a bearing case which is attached to the outer tub and contains a bearing for supporting the rotation shaft of the drum;

b) first engager which is fixed to the bearing case at least at a part, and has an actuator which moves between two positions to fix the rotational position of the drum at a predetermined stopping position; and c) second engager provided on the drum or on a member which rotates integrally with the drum, and positioned so as to engage with a part of the actuator when the actuator is at a first position and to release the engagement when the actuator is at a second position.

In the type of drum washing machine, in comparison with general outer tubs formed from a material such as plastic, whose strength is comparatively low although it has excellent workability, the bearing case is formed from a material such as an aluminum die-cast with high strength. When an undesirable force to rotate the drum is applied in a condition where the actuator of the first engager and the second engager engage with each other, the force is also applied to the first engager, however, at least a part of the first engager is fixed to the bearing case, whereby the fixed portion becomes strong and breakage and deformation can be prevented.

Furthermore, as mentioned above, the first engager is attached to the bearing case or the outer tub itself, however, since the outer tub is normally supported in a manner enabling it to oscillate by springs or dampers, the outer tub widely oscillates particularly in high-speed rotation of the drum. Such oscillation tends to be smaller at the lower side close to the damper than at tie upper side, so that the first engager having a movable part is provided lower than the drum shaft. Thereby, oscillation influence is relatively reduced, occurrence of malfunction is suppressed, and high reliability can be maintained.

According to a third aspect of the invention to achieve the abovementioned objects, a drum washing machine in which a drum whose circumferential surface is cylindrical is provided inside an outer tab provided in an outer casing so as to be rotatable around a horizontal shaft or an inclined shaft comprises a) a shaft member whose one end is fixed to the drum as the horizontal shaft or inclined shaft;

b) a bearing which is provided on the outer tub and supports the shaft member in a rotatable manner;

c) a drum rotation drive motor including a rotor attached to the other end of the shaft member and a stator attached to the outer tub side; and d) drum locking mechanism for locking the rotor of the motor to fix the rotational position of the drum at a predetermined stopping position.

In the drum washing machine according to the third aspect of the invention, for example, as mentioned above, when the drum is stopped at a position at which the laundry-loading opening, the outer tub opening, and the drum opening correspond to each other, in the drum and a member which rotates integrally with the drum, the rotation of the rotor provided outside the outer tub is stopped to fix the drum position. Therefore, there is no possibility that the drum locking mechanism submerges or is splashed with water, so that a water seal is not necessary. Furthermore, since the rotor has a diameter larger than that of the shaft member, positional accuracy can be easily made higher than in the case where the rotation of the shaft member itself is stopped.

As an embodiment of the drum washing machine according to the third aspect of the invention, the drum washing machine can be constructed so that the motor is an outer-rotor type motor and the rotor of the motor has a concave portion for engagement, the drum locking mechanism has an actuator which advances to or withdraws from the rotor, and that the drum is locked by engagement of a part of the actuator with the concave portion. Furthermore, it is preferable that the concave portion has guide pieces that extend outward at both sides of the inlet of the concavity, and fluffier preferably, the concave portion is provided at the outer circumferential edge of the rotor.

With the construction, when the actuator of the drum locking mechanism advances toward the rotor and the concavity of the concave portion exists ahead of the actuator, the front end of the actuator engages with the concavity to stop the rotor. In a case where the rotation of the rotor slightly offsets and the front end of the actuator comes into contact with the guide piece, the rotor is slightly rotated while maintaining the contact, whereby the front end of the actuator can be guided to the concavity. Thereby, the force for engagement can be reduced, and it is prevented that the actuator comes into contact with an undesirable portion and damages the actuator itself or a part of the rotor.

According to a fourth aspect of the invention to achieve the abovementioned objects, a drum washing machine in which a drum whose circumferential surface is cylindrical is provided inside an outer tub provided in an outer casing so as to be rotatable around a horizontal shaft or an inclined shaft, comprises a) a DC motor for driving the drum to rotate;

b) drum locking mechanism for locking the drum or member which rotates integrally with the drum to fix the rotational position of the drum at a predetermined stopping position; and c) drive controller using an inverter, which controls the DC motor so tat the drum reaches the vicinity of the predetermined rotating position when the drum locking mechanism locks the drum.

In the drum washing machine according to the fourth aspect of the invention, in a case where drum locking is carded out by fine speed control by means of inverter control using a DC motor so that for example, the actuator advances toward the rotor of the motor and engages with the concave portion formed in the rotor, an impact to be applied when and immediately after the actuator engages with the concave portion can be reduced. Therefore, it is prevented that a part of tie actuator or the rotor of the motor is damaged. Furthermore, engagement becomes more secure due to fine speed control, resulting in completion of drum locking in a short period of time.

Furthermore, in the drum washing machine according to the fourth aspect of the invention, it is preferable that the drive controller may uses attraction between the rotor and the stator of the DC motor when drum locking is carried out.

Namely, attraction and repulsion between the rotor and the stator can be generally used to rotate the rotor of the DC motor, however, substantially, repulsion is not used herein, and only attraction is mainly used. Thereby, intermittent rotation becomes easier although rotation smoothness is lost and furthermore, position holding stability becomes extremely high in the case of a temporary stop. Therefore, even when laundry shifts or is one-sided in the drum, the drum can be stably stopped at an optional position among a plurality of rotating positions that are determined depending on the layout of slots of the stator and magnets of the rotor, and a high torque can be obtained even in low-speed rotation. Therefore, drum locking mentioned above can be securely carried out, and it is more reliably prevented that a part of the actuator or the rotor of the motor is damaged.

According to a fifth aspect of the invention to achieve the abovementioned objects, a drum washing machine in which a drum whose circumferential surface is cylindrical is provided inside an outer tub provided in an outer casing so as to be rotatable around a horizontal shaft or an inclined shaft comprises a) a motor for driving the drum to rotate;

b) first engager having an actuator which moves between two predetermined positions to fix the rotational position of drum at a predetermined stopping position;

c) second engager provided on the drum or on a member which rotates integrally with the drum, and positioned so as to engage with a part of the actuator when the actuator is at a first position and to release the engagement when the actuator is at a second position;

d) engaging detector for detecting whether or not the actuator has engaged with the second engager; and e) controller for controlling the first engager and the motor while receiving detection signals from the engaging detector, which controls the actuator to move from the second position to the first position after controlling the motor so that the drum reaches a predetermined rotating position, and controls the motor so that the drum alternately rotates forward and rearward by a predetermined angle each turning in a situation where no detection signals are obtained from the engaging detector at the point.

In the drum washing machine according to the fifth aspect of the invention, when the actuator of the first engager is about to move from the second position to the first position, in a case where the second engager is positioned ahead of the actuator, the front end of the actuator engages with the second engager, however, in a case where the position of the second engager displaces, the front end of the actuator comes into contact with portions other than the concave portion and stops between the second position and the first position. In the condition, when the drum is driven to alternately rotate forward and rearward by a predetermined angle each turning, the second engager rotates while the front end of the actuator is in contact with portions other than the concave portion, so tat the actuator and the second engager engage with each other when the second engager comes to the position of the front end of the actuator, whereby fixation of the drum position is completed. This engagement is detected by the engaging detector, so that the controller stops motor drive after this in response to an engagement detection signal.

With the construction, even when drum locking is not successfully performed when the first engager is initially driven, as long as the second engager is in the vicinity of the fist position, drum locking can be completed in a short period of time. Therefore, the time required for drum locking can be shortened, and electric power required for driving the motor, etc., can be saved.

Furthermore, in the drum washing machine according to the fifth aspect of the invention, it is preferable that an abnormality notifying device is provided, which notifies a user of an abnormality in a case where fixation of the rotating position of the drum cannot be completed even by repetition of a predetermined number of times or for a predetermined period of time of retries. Thereby, driving is prevented from being wastefully continued in the abnormal condition of a malfunction, etc., and the notified user can quickly take countermeasures such that he/she contacts a service engineer.

Moreover, in the drum washing machine according to the fifth aspect of the invention, it is preferable that an abnormality notifying device is provided, which notifies a user of an abnormality in a case where control is made to release the fixation of the drum position and the release is not detected by the engaging detector.

Moreover, in the drum washing, machine according to the fifth aspect of the invention, it is preferable that drum exposure prohibiting device which locks a cover member provided on the outer casing in a closed condition or locks an outer tub door provided on the outer tub in a closed condition is provided so that the drum is locked by the drum exposure prohibiting device during rotation of the drum, and on the other hand, the lock by the drum exposure prohibiting device is released when fixation of the drum rotating position is not completed or the release of fixation of the position is not detected, Thereby, it becomes possible for a user to freely open the cover member and the outer tub door, so that a user can take laundry out of the drum and secure laundry even before repair.

According to a sixth aspect of the invention, a drum washing machine in which a drum whose circumferential surface is cylindrical is provided inside an outer tub provided in an outer casing so as to be rotatable around a horizontal shaft or an inclined shaft, comprises a) a motor for driving the drum to rotate;

b) first engager having an actuator which moves between two predetermined positions to fix the rotational position of drum at a predetermined stopping position;

c) second engager provided in a concave shape on the drum or on a member which rotates integrally with the drum, and positioned so as to engage with a part of the actuator when the actuator is at a first position and to release the engagement when the actuator is at a second position, and has guide pieces with a predetermined length at both sides of the inlet;

d) position detector for detecting whether or not the actuator is at the first position;

e) controller for controlling the first engager and the motor while receiving detection signals from the position detector, which controls the actuator to move from the second position to the first position after controlling the motor so that the drum reaches a predetermined rotating position, and controls the motor so as to rotate the drum in a predetermined direction in a case where no detection signals are obtained from the position detector at this point until a detection signal is obtained, and when a detection signal is obtained, controls the actuator to move from the first position to the second position so that the drum reaches the predetermined rotating position again and then makes a trial of fixation of the drum position.

In the drum washing machine according to the sixth aspect of the invention, when the actuator of the first engager is about to move from the second position to the first position, in a case where the second engager is positioned ahead of the actuator, the front end of the actuator engages with the second engager, however, in a case where the second engager displaces, the front end of the actuator comes into contact with the guide piece and stays between the second position and the first position. When the drum is driven to rotate in a predetermined direction in this condition, the second engager rotates while the front end of the actuator is in contact with the guide piece, and therefore, just when the font end of the actuator reaches the concave portion or deviates from the guide pieces, the actuator moves to the first position. At this point, there are two possibilities that the engagement has succeeded or has failed. Therefore, when the position detector detects that the actuator has reached the first position, control is made to temporarily return the actuator to the second position, and thereafter, drum locking is carried out from the beginning.

With this construction, since the actuator is temporarily returned to the second position when there is a possibility that the drum lock has failed, a fear of collision between the actuator and the second engager due to rotation of the drum in a condition where the actuator is at the first position is eliminated. Furthermore, the drum washing machine according to the sixth aspect of the invention is extremely effective in a case where a first engager is employed in which the actuator is prevented from returning to the second position unless the actuator has completely reacted the fist position when control is started to move the actuator from the second position to the first position.

According to a seventh aspect of the invention, a drum washing machine in which a drum whose circumferential surface is cylindrical is provided inside an outer tub provided in an outer casing so as to be rotatable around a horizontal shaft or an inclined shaft, comprises a) a motor for driving the drum to rotate;

b) first engager having an actuator which moves between two predetermined positions to fix the rotational position of the drum at a predetermined stopping position;

c) second engager provided in a concave shape on the drum or on a member which rotates integrally with the drum, and positioned so as to engage with a part of the actuator when the actuator is at a first position and to release the engagement when the actuator is at a second position, and has guide pieces with a predetermined length at both sides of the inlet;

d) position detector for detecting whether or not the actuator is at the first position;

e) rotation pulse generator for generating pulse signals in accordance with rotation of the drum or motor; and f) controller for controlling the first engager and the motor while receiving detection signals from the position detector and pulse signals from the rotation pulse generator, which counts the pulse signals from the timing at which the drum passes the predetermined rotating position in a condition where the drum rotates in a predetermined direction, and when the counting value reaches a predetermined value, controls the actuator to move from the second position to the first position, and controls the motor to stop the drum when a detection signal is obtained from the position detector.

The drum washing machine according to the seventh aspect of the invention is constructed so that in a condition where the drum is rotating in a predetermined direction, counting of the pulse signals is started from the timing at which the drum passes trough the predetermined rotating position, and when the counting value reaches a predetermined value, the drum reaches a rotating position at which the second engager comes to the forward side (rotation forward side) of the actuator of the first engager. Therefore, when the actuator of the first engager is about to move from the second position to the fist position, guide pieces of the second engager are positioned ahead of the actuator, and the front end of the actuator comes into contact with the guide pieces and stays between the second position and the first position. Then, when the drum rotates in the condition, the front end of the actuator reaches the concave portion, and the actuator moves to the first position, whereby drum locking is completed.

With the construction, drum locking can be securely carried out without fail. Furthermore, regardless of the rotating position of the drum, it is necessary that the drum makes almost a full turn before it is locked, however, since drum lock failures are eliminated, drum locking can be completed in a considerably short period of time on average.

BRIEF DESCRIPTION OF THE DRAWINGS

FIGS. 7A and 7B are drum locking device enlarged views, wherein FIG. 7A shows a condition where the drum lock is released, and FIG. 7B shows a condition where the lock operates;

DETAILED DESCRIPTION OF PREFERRED EMBODIMENTS

Hereinafter, a drum washing machine which is an embodiment of the invention is described with reference to the drawings.

Figure 1:
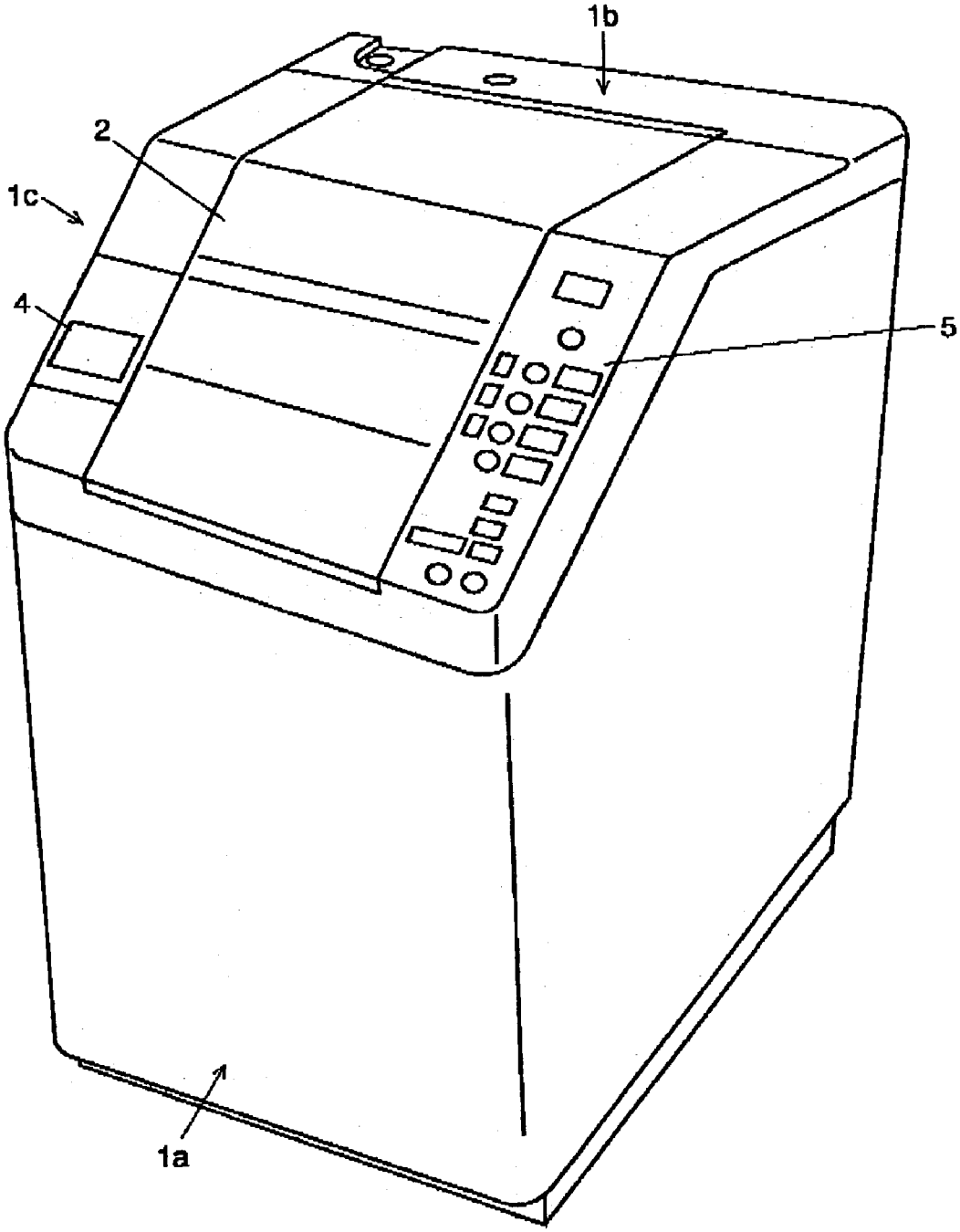
FIG. 1 is an exterior perspective view of a drum washing machine of an embodiment of the invention.
Figure 2:
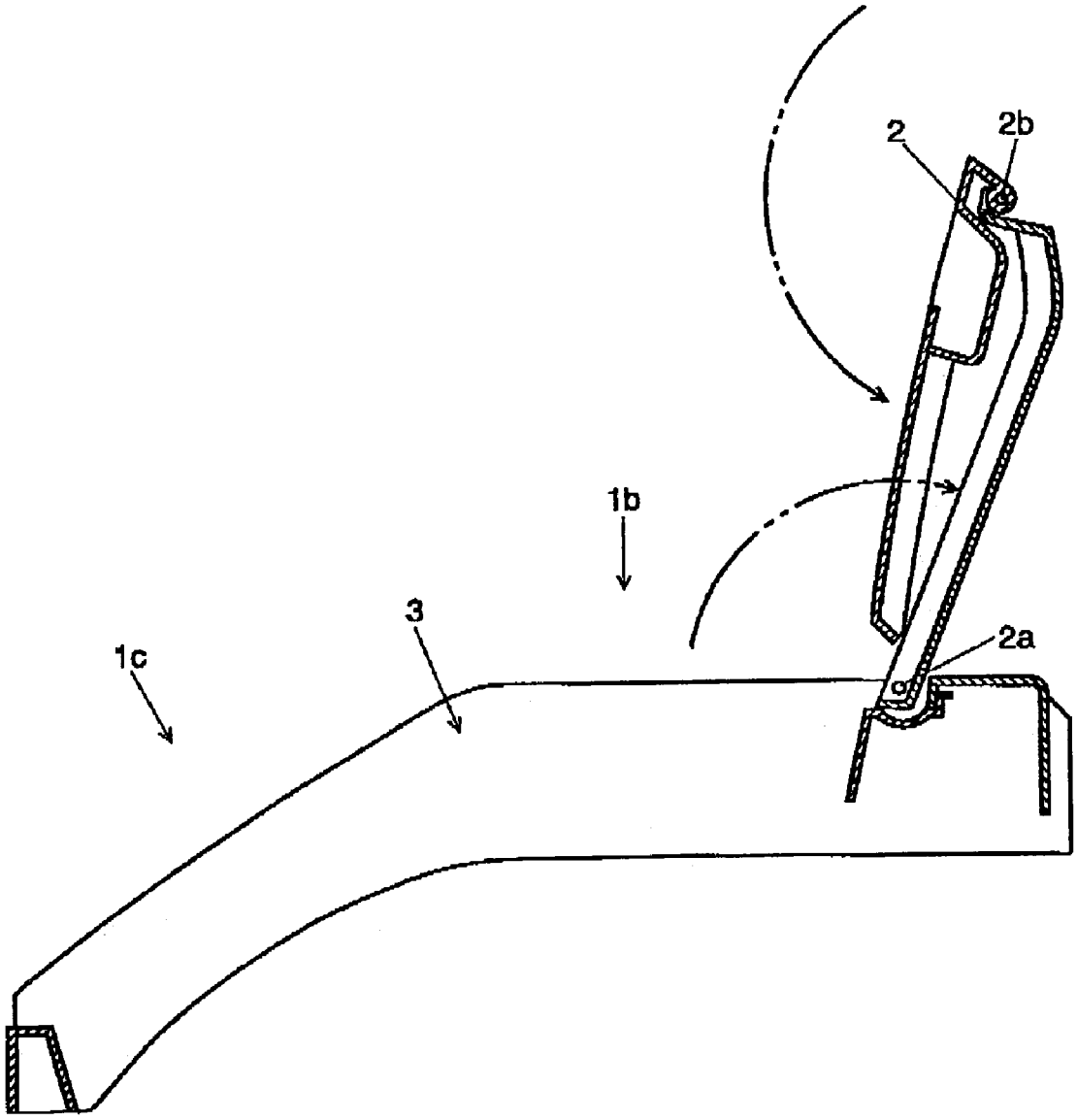
FIG. 2 is a longitudinal sectional side view of the top section of the drum washing machine of the embodiment.

FIG. 1 is an exterior perspective view of the drum washing machine of the embodiment, and FIG. 2 is a longitudinal sectional side view of the top section. In this drum washing machine, an outer casing is formed so that the corner between the top face part 1*a* and the front face part 1*b* is inclined toward the lower forward side while being rounded (hereinafter, referred to as "inclined portion 1*c*"). A large laundry-loading opening 3 is made from the inclined portion 1*c* to the top face part 1*a* at the rear side of the inclined portion, and an upper cover 2 for opening and closing the laundry-loading opening 3 can stand in a folded condition based on axes 2*a* and 2*b* extending horizontally in the lateral direction to rearward of the laundry-loading opening 3.

A detergent container 4 which can be drawn forward is provided at the left side of the upper cover 2, and an operation panel 5 is provided at the right side so as to extend lengthwise. On the operation panel 5, various operation keys for setting a washing course and a programming time, and various indicators which are lit according to these settings and inform of the progress of washing processes or indicate programming or the remainder of washing time are dispersedly ranged. The operation panel 5 entirely faces diagonally upward, so that when a user looks aslant down in a standing posture in front of the washing machine, the operation panel 5 surface becomes nearly perpendicular to the sight line, and therefore, the user can easily look at the indication and easily depress the operation keys.

Figure 3:
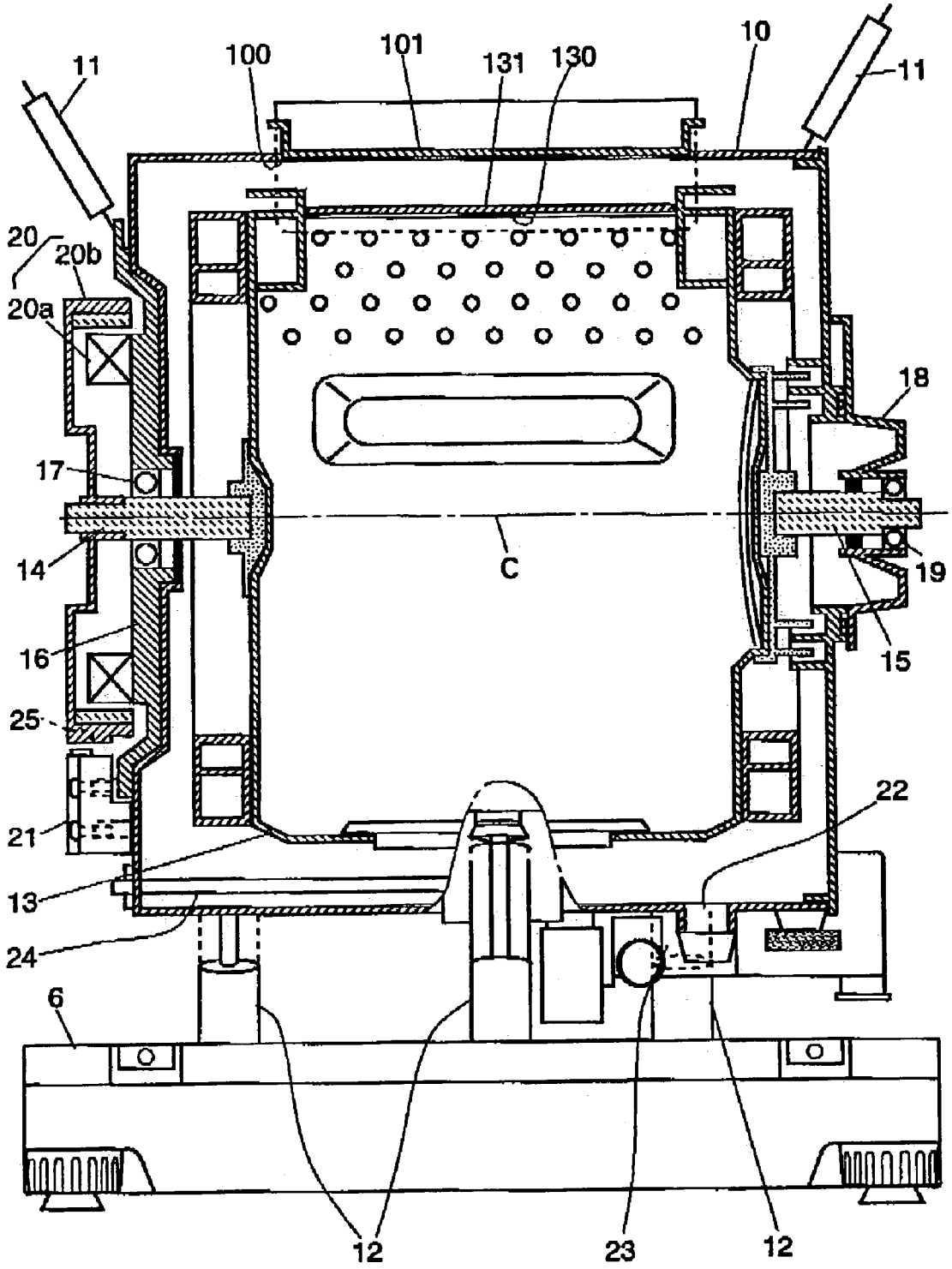
FIG. 3 is a longitudinal sectional front view of the main part of the interior of the drum washing machine of the embodiment.
Figure 4:
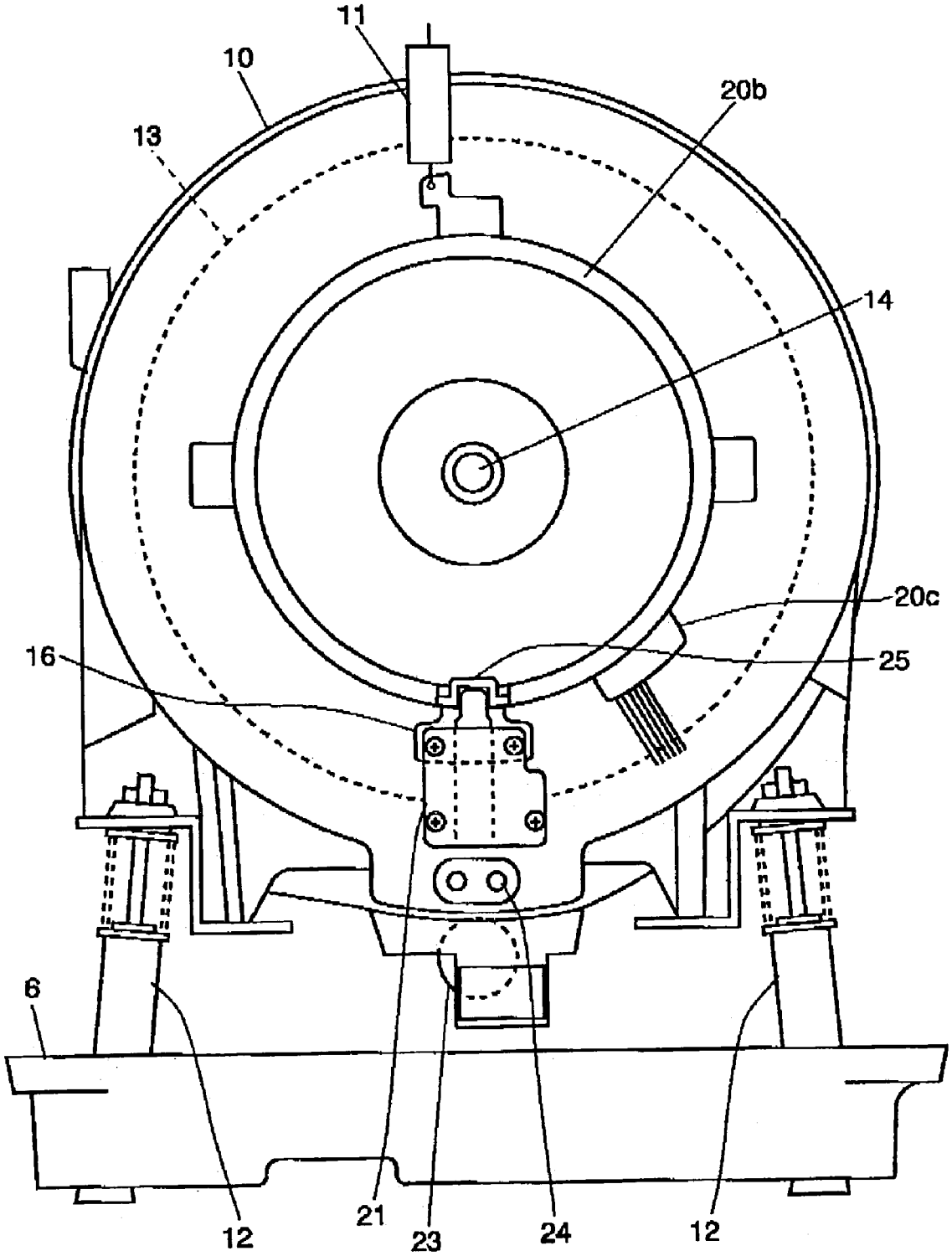
FIG. 4 is a left side view of the interior of the drum washing machine of the embodiment.
Figure 5:
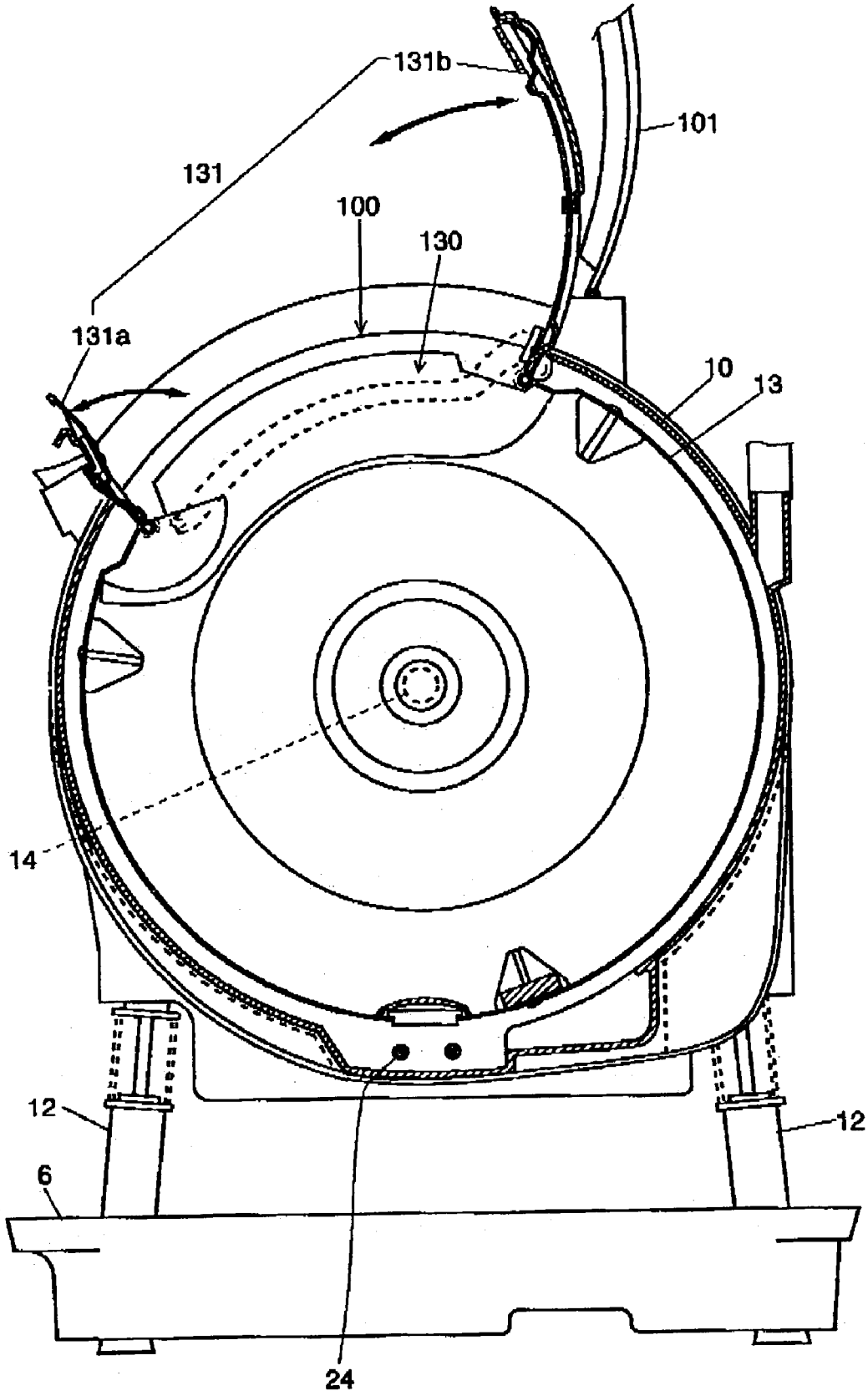
FIG. 5 is a longitudinal sectional right-side view of the interior of the drum washing machine of the embodiment.

Next, with reference to FIG. 3 through FIG. 5, the internal construction of the drum washing machine is generally described. FIG. 3 is a longitudinal sectional font view of the main part of the interior of the drum washing machine, FIG. 4 is a left side view of the same interior, and FIG. 5 is a longitudinal sectional right-side view of the same interior.

Inside the outer casing 1, on a setting base 6, an outer tub 10 which has a substantially cylindrical circumferential surface and almost closed both end faces is held so as to oppose the end faces to the respective left and right side surfaces of the outer casing 1 in a manner enabling the outer tub to moderately oscillate by two springs 11 for suspending and supporting from above the right and left sides and a damper 12 for supporting the lower portion of the outer tub 10 in the lengthwise diction. Inside the outer tub 10, as an inner tub for accommodating laundry, a horizontal drum 13 which has a substantially cylindrical circumferential surface having perforations and whose both end faces are closed is provided in a rotatable manner around a horizontal axis line C extending laterally.

The main shaft 14 fixed to the center of the left end face of the drum 13 is supported by a bearing 17 held in an aluminum die-cast first bearing case 16 which is fixed to the left end face of the outer tub 10. On the other hand, an auxiliary shaft 15 fixed to the center of the right end face of the drum 13 is supported by a second bearing 19 held in a second bearing case 18 which is fixed to the right end face of the outer tub 10. The abovementioned horizontal axis line C is formed by the main shaft 14 and the auxiliary shaft 15. At the front end of the main shaft 14 projecting sideward from the left end face of the outer tub 10, a rotor 20*b* of an outer-rotor type motor 20 is fixed, and meanwhile, a stator 20*a* of the motor 20 is fixed to the first being case 16 which is commonly used as a motor base. In response to a drive current supplied from a control circuit, which is not shown, to the stator 20, the rotor 20*b* rotates and the drum 13 is driven to rotate at the same rotation speed as that of the rotor 20*b* via the main shaft 14.

An outer tub opening 100 for loading and taking-out laundry is diagonally provided at a position corresponding to the laundry-loading opening 3 of the outer tub from the top of the circumferential surface of the outer tub 10 to the forward side, and the outer tub opening 100 is freely opened and closed by an outer tub door 101. A drum opening 130 for loading and taking-out laundry is also provided in the circumferential surface of the drum 13, and is freely opened and closed by a drum door 131 composed of two door members 131*a* and 131*b* having a hinged double-door structure forward and rearward. However, since the drum 13 is rotatable, in order for the drum opening 130 to maintain a stop condition where the drum opening 130 matches the outer tub opening 100 in the diameter direction, a drum lock device 21 is provided below the stator 20*a* as the abovementioned first engager.

It is dangerous that a user opens the outer tub door 101 while the drum 13 rotates, so that a door locking mechanism for prohibiting the outer tub door 101 from being opened is provided as the abovementioned drum exposure prohibiting device, which is not shown, and thus automatically locks the door during washing. For the same purpose, a lock mechanism which prohibits the upper cover 2 from being opened may be provide&

At the bottom of the outer tub 10, a drain 22 is provided and is connected to an external drain through an exhaust hose, which is not shown. A depressed portion is formed at the bottom of the outer tub 10, and water heater 24 for heating collected water is provided there.

A recirculating air flow channel is formed at the outer right side of the outer tub 10 to re-heat air from which water vapor from laundry is condensed, liquidized, and removed by hot air supplied into the drum for drying although it is not described in detail here.

Figure 6:
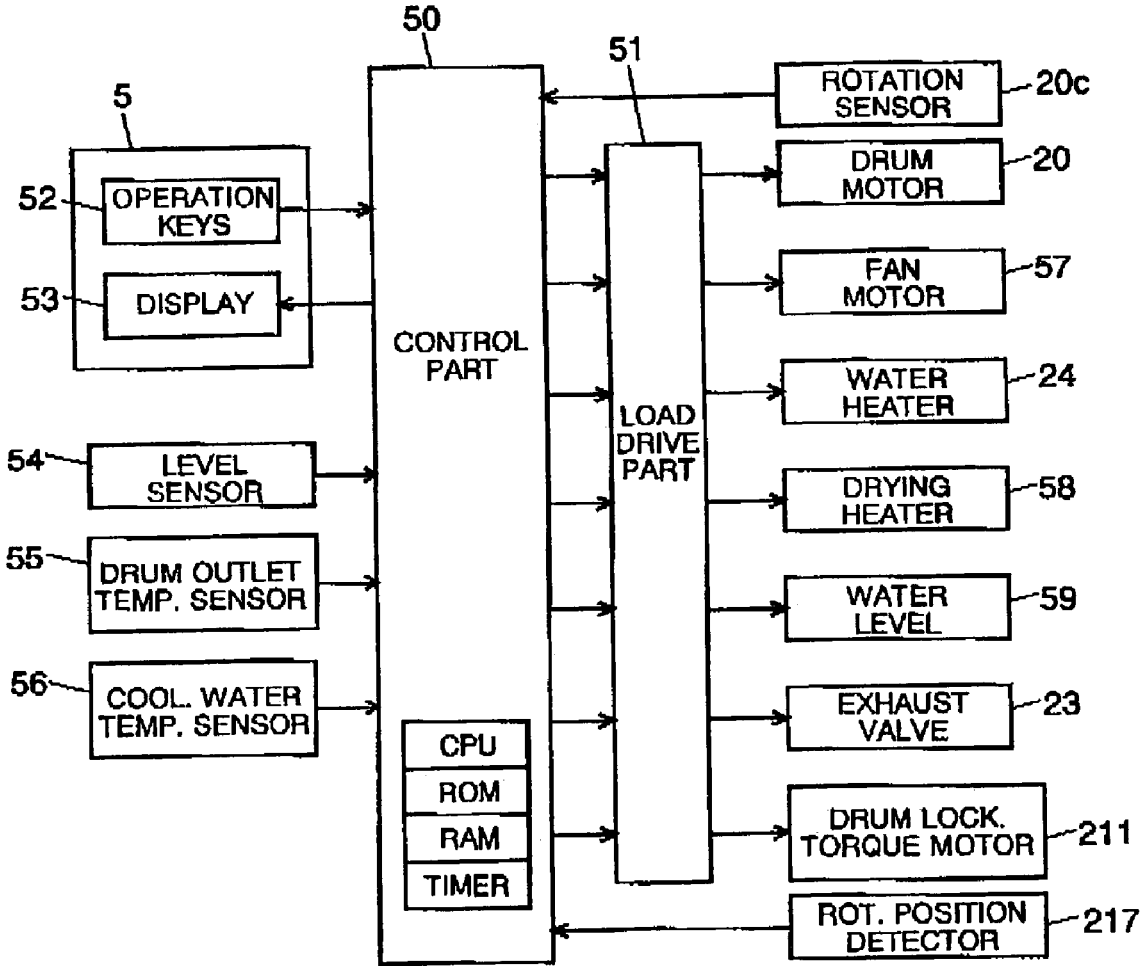
FIG. 6 is an electric system block diagram of the main part of the drum washing machine of the present embodiment.

FIG. 6 shows an electrical system construction of the main part of the drum washing machine of the embodiment. A control part 50 mainly comprises a microcomputer including a CPU, a ROM, a RAM, and a timer, etc., and performs various controls of operations in the respective processes including washing, rinsing, spin-drying, and drying. To the control part 50, key input signals are supplied from various operation keys 52 provided on the operation panel 5 in order for a user to make various settings and instructions, and furthermore, detection signals are inputted from a level sensor 54 for detecting the level of water collected in the outer tub 10, a drum outlet temperature sensor 55 for detecting a water temperature in the washing and rinsing processes and detecting the temperature of the drum outlet side in the drying process, a cooling water temperature sensor 56 for detecting the temperature of cooling water in the drying process, and a rotation sensor 20*c* which is attached to a dry motor 20 and includes a hall element etc., for detecting the rotating position of the drum motor 20.

Furthermore, a load drive part 51 is connected to the control part 50 to control operations of the drum motor 20, a fan motor 57, a water heater 24, a drying heater 58, a water valve 59, and an exhaust valve 23 via the load drive part 51. Furthermore, for locking the drum to prohibit the drum 13 from rotating as described later, the control part 50 controls the operation of a torque motor 211 which is equipped in the drum locking device 21 while receiving detection signals from a rotating position detector 217 installed inside the torque motor 211.

Next, characteristic components of the drum washing machine of the embodiment are described in detail. First, the construction of the drum locking device 21 in the drum washing machine is described with reference to FIGS. 7A and 7B as well as FIGS. 3 and 4 described in the above. FIGS. 7A and 7B are enlarged views of the drum locking device 21, wherein FIG. 7A shows the condition where the drum lock is released, and FIG. 7B shows the condition where the drum is locked.

The drum locking device 21 comprises a torque motor 211, which is a drive source, an actuator 213 having a lock pin 21 at its end portion, a spring 214 for pressing the actuator 213, and a cam 215 fixed to the rotation aft of the torque motor 211, and so on, and the drum locking device 21 is fixed across the first bearing case 16 and the outer tub 10. The outer tub 10 is made from plastic, however, the first bearing case 16 is made from aluminum die-cast, and this achieves secure holding of the drum locking device 21. The actuator 213 is movable only upward and downward along a guide groove formed in the case, and is pressed upward by the spring 214. A convex portion 216 provided on the cam 215 is movable within the opening 213*a* formed in the actuator 213.

On the other hand, an engaging groove part 25 which serves as the abovementioned second engager and receives the lock pin 212 is provided at the outer circumferential edge of the rotor 20*b* of the drum motor 20, and guide pieces 25*a* are provided on the left and right of the engaging groove into which the lock pin 212 fits (the forward side and the rear side of the rotating direction of the rotor 20*b*).

Thereby, as shown in FIG. 7(A), when the convex portion 216 is at the lowest position, the convex portion 216 presses the actuator 213 downward against the pressing force of the spring 214, whereby the lock pin 212 is drawn downward (that is, withdrawn). When the torque motor 211 is rotated counterclockwise from the condition, in response to the rotation, the convex portion 216 rises, and accordingly, the actuator 216 gradually moves upward due to the pressing force of the spring 214. Thereby, the lock pin 212 starts advancing upward.

As shown in FIG. 7(B), just when the cam 215 half-turns and the convex portion 216 reaches the highest position, the actuator 213 also reaches the highest position, and the lock pin 212 advances to the maximum. In this condition, when the engaging groove part 25 exists at the forward side of this advancing, the lock pin 212 fits into the groove of the engaging groove part 25 to lock of the rotor 20*b*. That is, the drum 13 is locked. Since the front end of the lock pin 212 is shaped into a trapezoid by cutting both corners, even when the position of the lock pin 212 and the position of the groove of the engaging groove part 25 slightly deviate from each other, by contact of the cut-off portions of the lock pin 212 with both comers of the inlet of the groove of the engaging groove part 25, the engaging groove part and the lock pin fit together by sliding along the inclinations of the cut-off portions.

Furthermore, when the torque motor 211 is rotated counterclockwise, the convex portion 216 lowers in response to the rotation, and accordingly, the actuator 213 gradually moves downward. Then, the lock pin 212 is released from the groove of the engaging groove part 25, and the rotor 20*b* becomes freely rotatable. That is, the drum lock is released.

Thus, drum lock and lock release are achieved in accordance with rotational operations of the torque motor 211 which rotates in only one direction. Furthermore, as mentioned above, the rotating position detector 217 for detecting the rotating position of the shaft of the torque motor 211 is installed inside the torque motor 211 so that it is judged whether the lock pin 212 has advanced or withdrawn depending on the detection signal from the rotating position detector. Although a solenoid can be used for the mechanism of reciprocating the actuator 213, use of a torque motor is advantageous since operation noise is suppressed and breakage due to an abnormal current flow is prevented even when the lock pin is stopped in the middle of advance.

Figure 8:
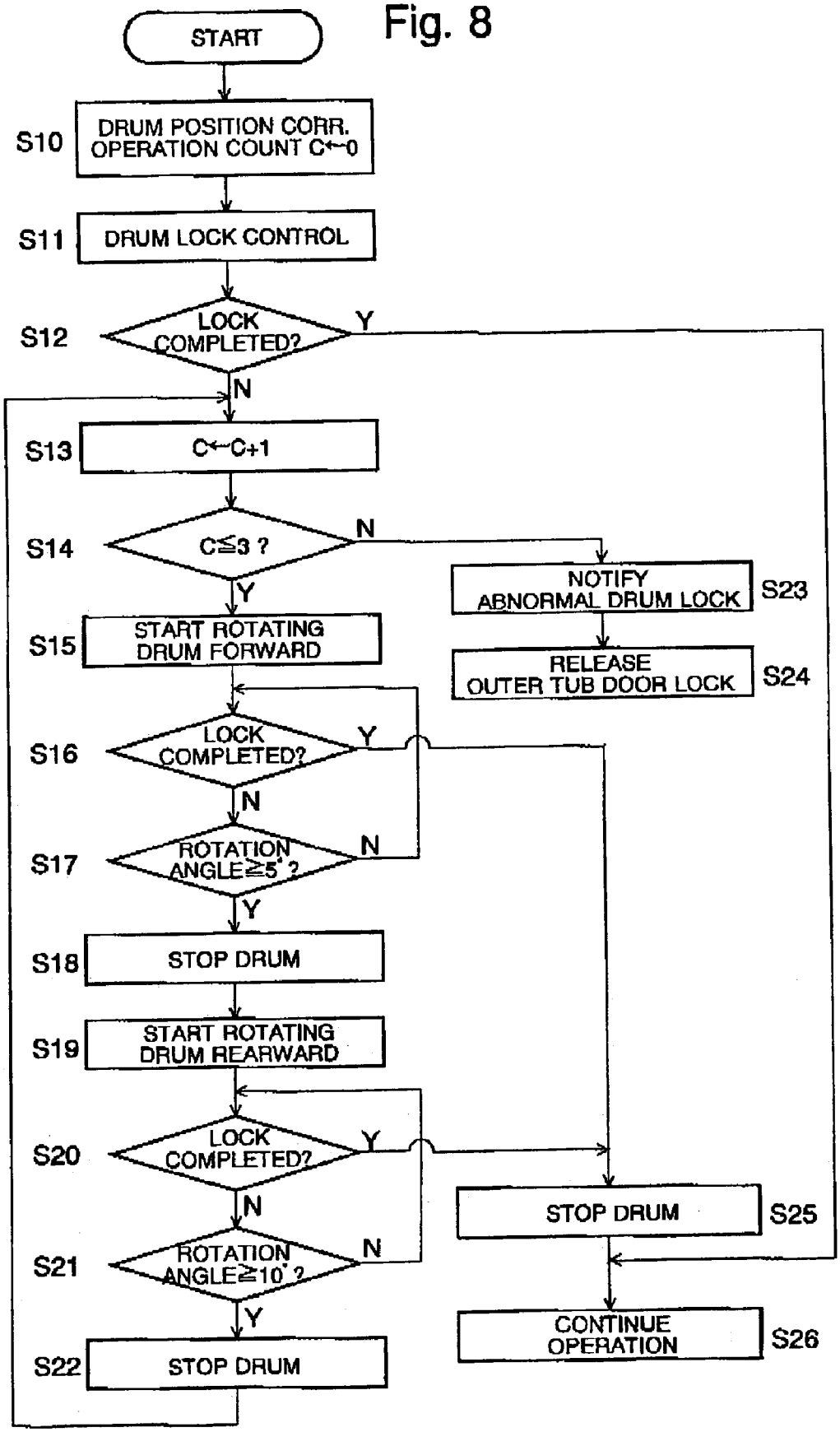
FIG. 8 is a flowchart showing an example of a method for controlling the drum lock operation.

Next, controlling operations for drum locking are described in detail with reference to the flowchart of FIG. 8. In the control part 50, the drum position correcting operation counter C is reset to zero (Step S10). Then, after the drum motor 20 is driven and the rotation is stopped at a predetermined position, the torque motor 211 is driven to advance the lock pin 212 as mentioned above (Step S11). Immediately after this, it is judged whether or not drum locking has been completed (Step S12). Herein, drum locking is regarded as completed when it is detected that the cam 215 has rotated to a predetermined position based on a detection signal from the rotating position detector 217. Therefore, the rotating position detector 217 functions as the abovementioned position detector in conjunction with a part of the control part 50. When drum locking is regarded as completed when the lock pin 212 fits into the groove of the engaging groove part 25, the process progresses to Step S26 to continue the driving operation other than drum locking.

In the first rotating position alignment by driving the drum motor 20, slight misalignment may occur. As a result, if the position of the lock pin 212 and the position of the groove of the engaging groove part 25 deviate from each other, the lock pin 212 comes into contact with the guide piece 25*a* projecting sideward of the engaging groove part 25. This obstructs farther rotation of the torque motor 211, and as a result, it cannot be judged that drum locking has been completed in Step S12. Therefore, the drum position correcting operation counter C is incremented (Step S13), and it is judged whether or not a resultant value is 3 or less (Step S14). If the value is 3 or less, the drum 13 is controlled so as to rotate forward little by little (Step S15). At this point, the rotor 20*b* rotates while leaving the lock pin 212 in contact with the guide piece 25*a* of the engaging groove part 25. Then, while judging whether or not drum locking has been completed, the drum 13 is rotated until the rotation angle reaches 5 degrees (Steps S16 and S17). In a case where the lock pin 212 fits into the groove at this point, completion of drum locking is judged, so that the process progresses to Step S25, the rotation of the drum motor 20 is stopped, and then the drive is continued.

In a case where the rotation angle reaches 5 degrees although completion of drum locking has not been detected, the drum motor 20 is temporarily stopped (Step S18), and then the drum motor 20 is controlled to rotate rearward little by little (Step S19). Then, while judging whether or not drum locking has been completed, the drum 13 is rotated until the rotation angle reaches 10 degrees (that is, rotated by 5 degrees in the rearward direction from the condition before starting forward rotation) (Steps S20 and S21). In a case where the lock pin 212 fits into the groove of the engaging groove part 25 at this point, completion of drum locking is judged, so that the process progresses to Step S25 and the rotation of the drum motor 20 is stopped, and then the drive is continued.

When the rotation angle reaches 5 degrees although completion of drum locking has not been detected, the drum motor 20 is temporarily stopped (Step S22), and the process returns to Step S13. Therefore, drum locking is attempted by repeating processings of the abovementioned Steps S13 through S22 up to 3 times. When the drum position correcting operation counter C exceeds 3, the process progresses to Step S23 from Step S14, a user is notified of abnormal drum locking by means of a buzzer or indication, and the lock of the outer tub door 101 is released (Step S24). Thereby, it becomes possible to open the outer tub door 101, and a user can take-out laundry by opening the upper cover 2, outer tub door 101, and drum door 131 if necessary.

As mentioned above, in the drum washing machine of the present embodiment, the lock pin 212 and the groove of the engaging groove part 25 are set in proximity to each other and a fitting position of these is found by slightly rotating the drum 13 forward and rearward, so that the drum can be locked in a short period of time.

As described above, positional alignment by means of drive of the drum motor 20 is not rigorous, however, by rotating the drum 13 by only ±5 degrees as mentioned above, a position for drum locking can be found in most cases. However, in a case where the first positional alignment accuracy is lower, there is a possibility that the lock pin 212 deviates from the guide piece 25*a* to the outside when rotating the drum by ±5 degrees. If the lock pin 212 deviates from the guide piece 25*a* to the outside, the lock pin 212 advances to the maximum in this condition, resulting in detection signals of the rotating position detector 217 in the same condition as the case of completion of drum locking, and therefore, it is erroneously judged that drum locking has been completed. Therefore, when the first alignment accuracy is low, drum locking is executed by another control described below.

Figure 9:
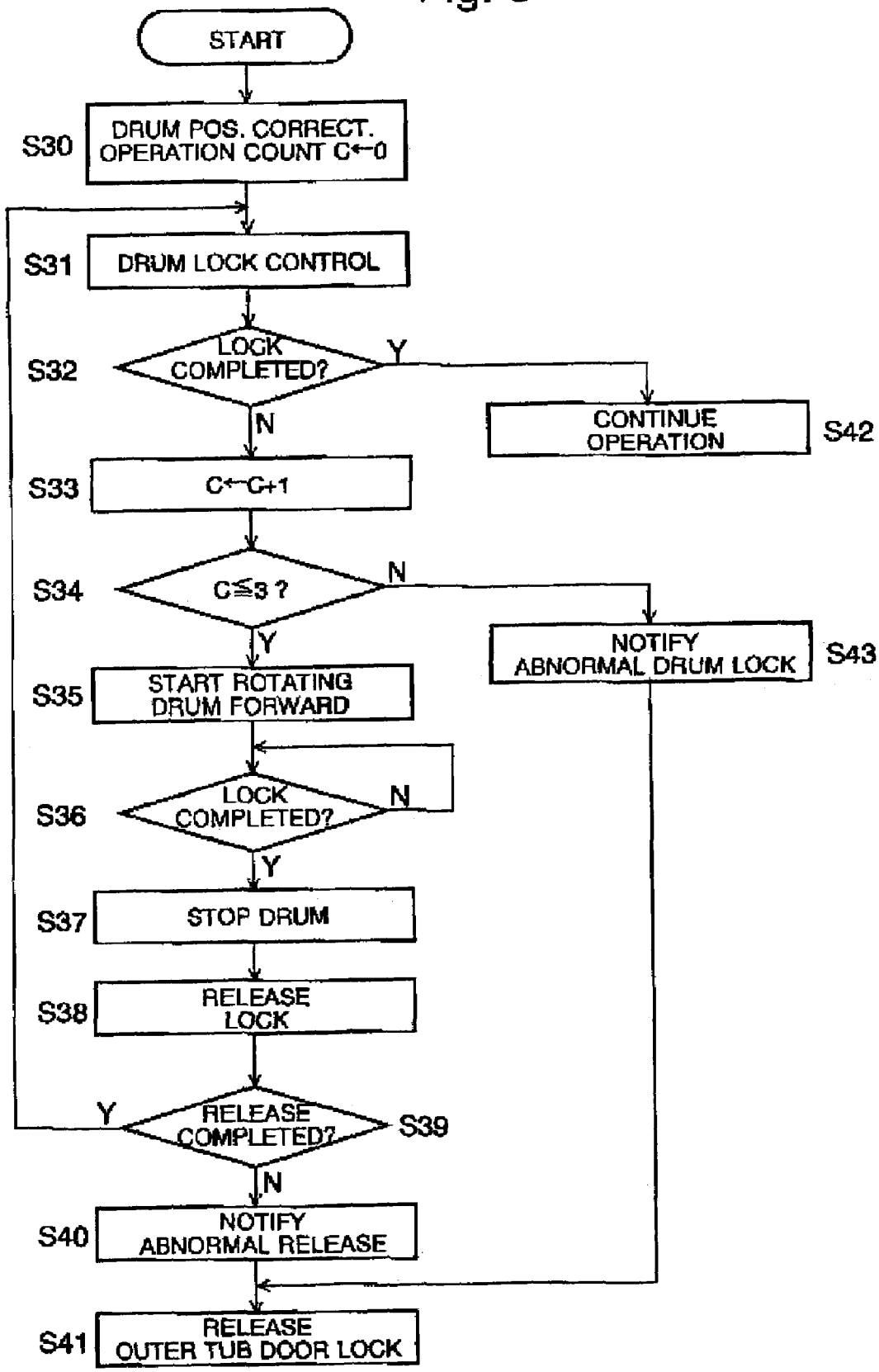
FIG. 9 is a flowchart showing another method for controlling the drum lock operation.

Drum locking control by another method is described with reference to the flowchart of FIG. 9. At the control part 50, the drum position correcting operation counter C is reset to zero (Step S30). Then, after the drum motor 20 is driven and its rotation is stopped at a predetermined position, the torque motor 211 is driven to advance the look pin 212 as mentioned above (Step S31). Thereafter, it is judged whether or not drum locking has been completed (Step S32), and when completion of drum locking is judged, driving operation other than drum locking is continued (Step S42).

When it is judged in Step S32 that drum locking has not been completed, the drum position correcting operation counter C is incremented (Step S33), and it is judged whether or not a resultant value is 3 or less (Step S34). When the value is 3 or less, the drum motor 20 is controlled so as to rotate the drum 13 forward little by little (Step S35). At this point, the rotor 20*b* rotates while the lock pin 212 is in contact with the guide piece 25*a* of the engaging groove part 25. The drum 13 is rotated until it is judged that drum locking has been completed (Step S36), and when completion of drum locking is judged, the drum motor 20 is temporarily stopped and then the drum lock is released by further half-turning the torque motor 211, that is, the lock pin 212 is withdrawn (Step S38). Then, when it is judged that the drum lock has been released, that is, the lock pin 212 has been withdrawn by a detection signal from the rotating position detector 217, the process returns to Step S31 and the drum locking operation is re-attempted.

In a case where lock releasing is not detected in Step S39, a user is notified of abnormal drum lock releasing by means of a buzzer or indication (Step S40), and then the lock of the outer tub door 101 is released (Step S41). By the control method, in a case where drum locking is failed, the lock pin 212 is temporarily withdrawn, so that there is no possibility that a case where the drum 13 is rotated while the lock pin 212 has been advanced results in breakage by collision of the lock pin 212 against the engaging groove part 25.

Figure 10:
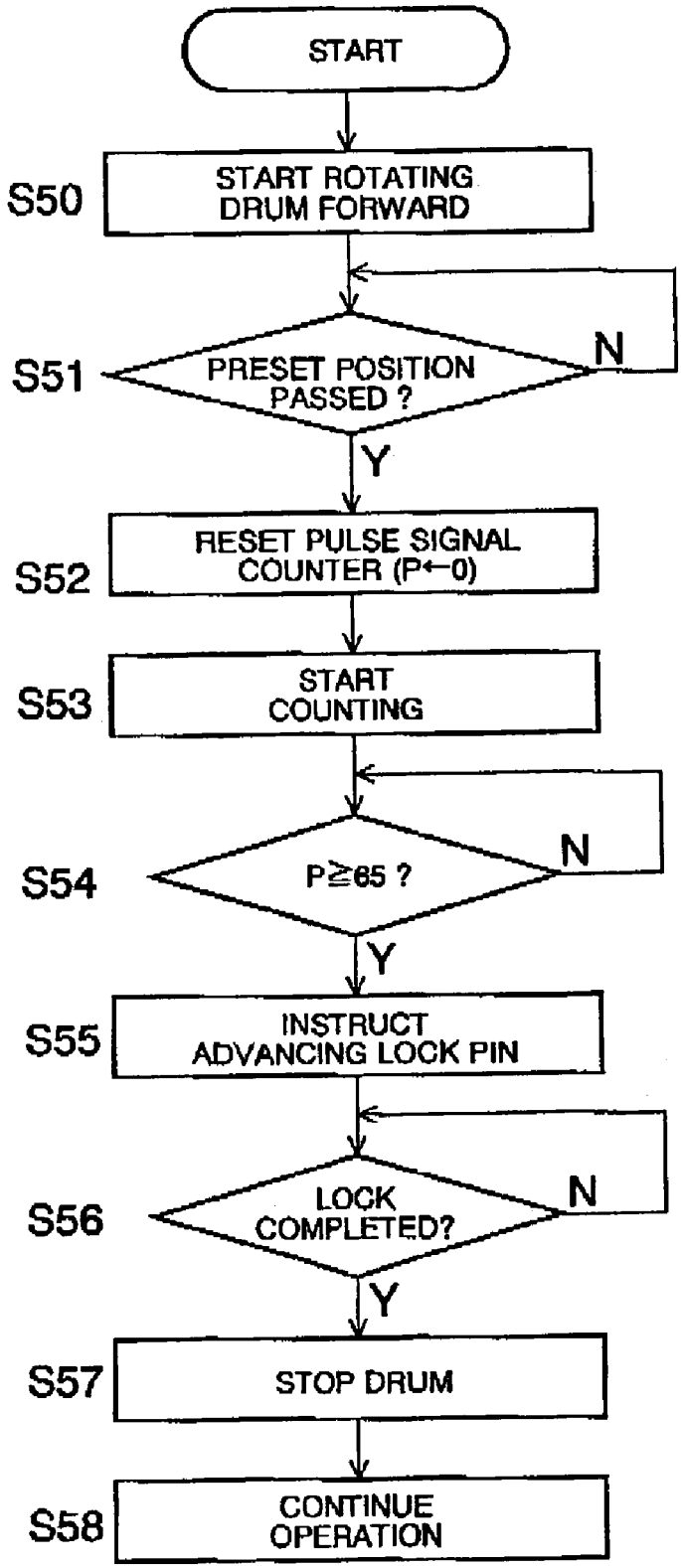
FIG. 10 is a flowchart showing still another method for controlling the drum lock operation.

Furthermore, still another method of controlling the drum locking operation shown in the flowchart of FIG. 10 can be used. In this control, pulse signals which are generated for each rotation of the drum motor 20 by a predetermined angle, that is, detection signals of the rotation sensor 20*c* in FIG. 6 are used. Herein, the number of pulse signals to be generated per one turning of the drum 13 is set to 72.

For drum locking, first, the drum motor 20 is driven to rotate forward at a predetermined speed (Step S50), and when it is detected that the drum 13 has passed a predetermined rotating position (Step S51), the counter of pulse; signals from the rotation sensor 20*c* is reset (Step S52). Then, counting is started from the condition where the counting value P is zero (Step S53), and when it is detected that the counting value P has reached 65 ("Y" in Step S54), that is, when the drum 13 rotates by approximately 325 degrees after the counter is reset, driving of the torque motor 211 is started and the lock pin 212 is started advancing (Step S55). In actuality, advancing of the lock pin 212 to a degree at which the lock pin fits into the groove of the engaging groove part 25 or comes into contact with the guide pieces 25*a* has a slight time delay, so that the lock pin 212 comes into contact with the guide pieces 25*a* immediately before the groove of the engaging groove part 25 comes to the advance position of the lock pin 212, and then, the lock pin 202 fits into the groove by slight rotation of the rotor 20*b* while the lock pin is in contact with the guide pieces 25*a*. Then, it is judged that drum locking has been completed ("Y" in Step S56), so that the drum motor 20 is stopped (Step S57).

Until an instruction to advance the lock pin 212 is given, the rotation speed of the drum motor 20 may be a little high, however, after the instruction is supplied, the rotation speed is lowered to weaken the impact of contact of the lock pin 212 with the engaging groove part 25. By the control, the probability of failure in drum locking operation becomes extremely low, so that there is a possibility that don locking is completed in the shortest period of time on average.

When drum locking is carried out as mentioned above, in order to reduce the mechanical loads on the lock pin 212 and the rotor 20 as much as possible, intermittent rotating drive is desirable in which the rotor 20*b* is rotated by a minute angle and then temporarily stopped, and at this point, it is detected whether or not the drum has been locked, and if necessary, (for example, when the drum has not been locked), the rotor 20*b* is further rotated by a minute angle. Such fine speed control is difficult when an induction motor is used, so that a DC brushless motor is used for the drum motor 20, and the motor is inverter-driven. However, even when a DC brushless motor is used, in a case where the drum 13 is driven to rotate at a low speed, a generated torque becomes low, and in a condition where laundry is accommodated in the drum 13, the laundry shifts during a temporary stop after minute rotation of the drum 13, and the moving force of the laundry easily rotates the drum 13, and therefore, it is difficult to maintain a stable temporary stop.

Therefore, in the drum washing machine of the embodiment a rotation control method described below is employed to generate a torque sufficient even for low-speed intermittent rotation to obtain stability. This rotation control method is described. Generally, rotation control of a DC brushless motor is made so that the rotor is smoothly rotated by using magnetic attraction and magnetic repulsion, however, in the drum washing machine, magnetic repulsion is not substantially used but only magnetic attraction is used to improve maintaining performance of the position of temporary stop when the rotor is intermittently rotated.

FIG. 11 are operation principle drawings of drum control to be used for drum lock operation in the washing machine. For the sake of simplification, the rotor is set at the center and a suitor composed of three U, V, and W phases is set at the outer circumferential side in these drawings, however, in an actual drum motor 20, the magnet has 24 poles, and the stator 20*a* has 36 slots.

Figure 11A:
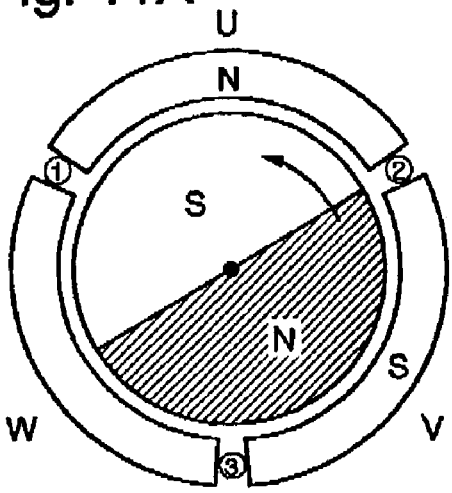
FIG. 11 are operation principle drawings of drum control for drum lock operation in the drum washing machine of the embodiment.
Figure 11F:
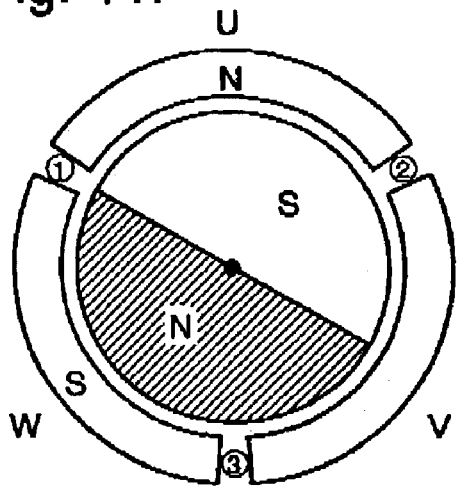
Figure 11B:
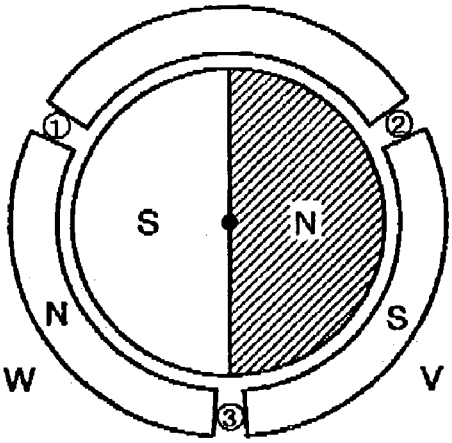
Figure 11E:
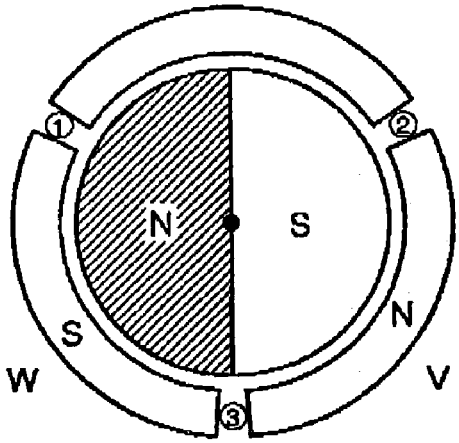
Figure 11C:
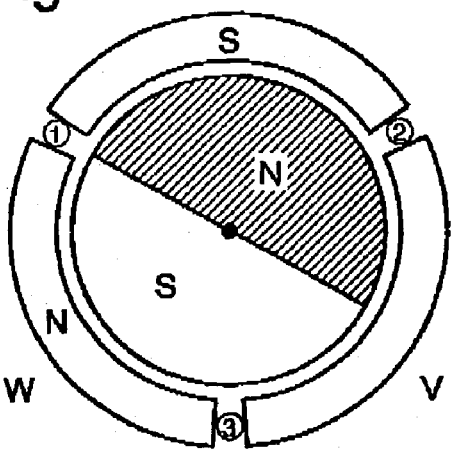
Figure 11D:
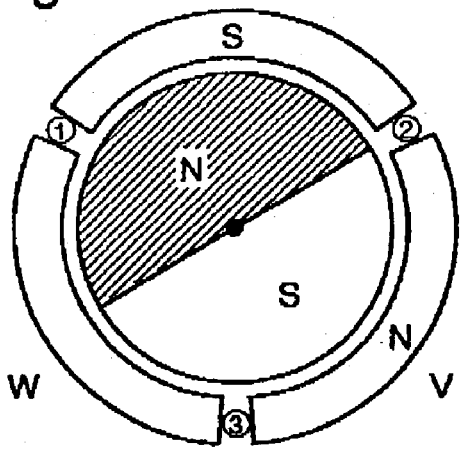

First, as shown in FIG. 1(A), when a current is supplied to the U phase and the V phase, respectively, so that the U phase becomes the N pole and the V phase becomes the S pole, the rotor is held at the illustrated position. Then, as shown in FIG. 11(B), when a current is supplied to the W phase and the V phase, respectively, so that the W phase becomes the N pole and the V phase becomes the S pole, the rotor further rotates counterclockwise by about 60 degrees and is held at the illustrated position. Then, as shown in FIG. 11(C), a current is supplied to the W phase and the U phase, respectively, so that the W phase becomes the N pole and the U phase becomes the S pole, thereby the rotor is further rotated by about 60 degrees counterclockwise and held at the illustrated position. Thus, by shifting the phase to be supplied with a current one by one, the rotor can be intermittently rotated in increments of 60 degrees. In the respective conditions shown in FIG. 11, the rotating position is maintained by only magnetic attraction. Therefore, the position is stable, and even if a force for rotating the rotor is applied from the outside, the rotor is prevented from rotating readily.

In actual control, for example, when a command to stop the drum 13 from the condition where the drum motor 20 is being driven to rotate in a normal control is provided, the control is switched to the abovementioned control, and when the drum motor 20 is rotated by a predetermined angle under the abovementioned control in response to a Z phase signal which is outputted only once per one turn of the drum motor 20, the drum motor 20 is stopped. At this point, since the position of the rotor 20*b* is fixed by only magnetic attraction as mentioned above, the rotor 20*b* can be maintained in almost a still condition regardless of the loading condition inside the drum 13. For example, in the control example shown in FIG. 9, the torque motor 211 is controlled to me the lock pin 212 advance in this condition. Thereby, the rotor 20*b* is prevented from moving when the lock pin 212 is inserted into the groove of the engaging groove part 25, and an impact is hardly applied on the lock pin 212.

The abovementioned embodiment is an example of the present invention, and it can be suitably changed or amended within the scope of the invention.

What is claimed is:

1. A drum washing machine in which a drum is provided in an outer tub placed in an outer casing, where the drum is rotatable on a horizontal shaft or on an inclined shaft and the circumferential surface of the drum is substantially cylindrical, the drum washing machine comprising:

a) a shaft member whose one end is fixed to the drum as the horizontal shaft or inclined shaft;

b) a bearing provided on the outer tub for supporting the shaft member in a rotatable manner;

c) a drum rotation drive motor including a rotor attached to the other end of the shaft member and a stator attached to the outer tub side, the motor being a DC motor that includes the rotor and the stator for driving the drum to rotate;

d) a drum locking mechanism for locking the rotor of the motor to fix a rotational position of the drum at a predetermined stopping position, the drum locking mechanism locking the drum by locking the rotor, which is a member which rotates integrally with the drum to fix a rotational position of the drum at a predetermined stopping position; and e) a drive controller using an inverter for controlling the DC motor so that the drum comes to a vicinity of the predetermined rotating position when the drum locking mechanism locks the drum;

wherein the motor is an outer-rotor type motor, the rotor of the motor has a single concave portion for engagement, the drum locking mechanism has an actuator which advances to or withdraws from the rotor, and the rotor of the motor is locked by engagement of a part of the actuator with the concave portion.

2. The drum washing machine according to claim 1, wherein the drive controller makes control so as to mainly use attraction between the rotor and the stator of the DC motor at least when the drum is locked.

* * * * *